US009790576B2

(12) United States Patent
Fujita et al.

(10) Patent No.: US 9,790,576 B2
(45) Date of Patent: Oct. 17, 2017

(54) TITANIUM OR TITANIUM ALLOY PLATE EXCELLENT IN BALANCE BETWEEN PRESS FORMABILITY AND STRENGTH

(75) Inventors: Akihisa Fujita, Kakogawa (JP); Hideto Oyama, Kakogawa (JP); Yoshio Itsumi, Kakogawa (JP); Tadashige Nakamoto, Kakogawa (JP); Kayo Yamamoto, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 1331 days.

(21) Appl. No.: 13/130,497

(22) PCT Filed: Dec. 10, 2009

(86) PCT No.: PCT/JP2009/070689
§ 371 (c)(1),
(2), (4) Date: May 20, 2011

(87) PCT Pub. No.: WO2010/067843
PCT Pub. Date: Jun. 17, 2010

(65) Prior Publication Data

US 2011/0229713 A1 Sep. 22, 2011

(30) Foreign Application Priority Data

Dec. 12, 2008 (JP) ..... 2008-317041
May 14, 2009 (JP) ..... 2009-117844

(51) Int. Cl.
*C22C 14/00* (2006.01)
*C22F 1/18* (2006.01)
(Continued)

(52) U.S. Cl.
CPC ..... *C22C 14/00* (2013.01); *B05D 7/16* (2013.01); *B21B 3/00* (2013.01); *C22F 1/183* (2013.01);
(Continued)

(58) Field of Classification Search
CPC ..... C22C 14/00; C22F 1/183; F28F 21/086; F28F 2255/08; C23C 30/00; C23C 26/00;
(Continued)

(56) References Cited

U.S. PATENT DOCUMENTS 6,797,770 B1 9/2004 Mori et al.
2004/0035503 A1 2/2004 Fuji et al.

FOREIGN PATENT DOCUMENTS

EP 1 172 426 A1 1/2002
JP 59 1661 1/1984
(Continued)

OTHER PUBLICATIONS

Effect of Temperature on Anisotropy in Forming Simulation of Aluminum Alloys, S. Kurukuri, A. Miroux, M. Ghosh, A.H. van den Boogaard; International Journal of Material Forming Aug. 2009, vol. 2, Issue 1 Supplement, pp. 387-390.*
(Continued)

*Primary Examiner* — Kevin R Kruer
(74) *Attorney, Agent, or Firm* — Oblon, McClelland, Maier & Neustadt, L.L.P.

(57) ABSTRACT

Disclosed is a titanium or titanium alloy plate rolled in one direction, wherein a lubricating film is coated on the surface and the coefficient of sliding friction of the lubricating film-coated surface is controlled to less than 0.15. The elongation (L-El) of the titanium or titanium alloy plate in the rolling direction and the r value (T-r) in the direction perpendicular to the rolling direction have the following relation (1).

$$(T\text{-}r)/(L\text{-}El) \geq 0.07 \quad (1)$$

14 Claims, 4 Drawing Sheets

(51) Int. Cl.

| | |
|---|---|
| ***F28F 21/08*** | (2006.01) |
| ***C23C 30/00*** | (2006.01) |
| ***B21B 3/00*** | (2006.01) |
| ***C23C 26/00*** | (2006.01) |
| ***B05D 7/16*** | (2006.01) |
| *B21B 45/02* | (2006.01) |

(52) U.S. Cl.
CPC ..... *C23C 26/00* (2013.01); *C23C 30/00* (2013.01); *F28F 21/086* (2013.01); *B05D 2202/35* (2013.01); *B05D 2502/00* (2013.01); *B05D 2701/10* (2013.01); *B21B 45/0239* (2013.01); *F28F 2255/08* (2013.01); *Y10T 428/254* (2015.01); *Y10T 428/266* (2015.01); *Y10T 428/31678* (2015.04)

(58) Field of Classification Search
CPC ..... B21B 3/00; B05D 7/16; B05D 2701/10; B05D 2502/00; B05D 2202/35; Y10T 428/31678; Y10T 428/254; Y10T 428/266
See application file for complete search history.

(56) References Cited

FOREIGN PATENT DOCUMENTS

| | | | |
|---|---|---|---|
| JP | 05-237449 | * | 9/1993 |
| JP | 6 173083 | | 6/1994 |
| JP | 8 53726 | | 2/1996 |
| JP | 09-216004 | * | 8/1997 |
| JP | 9 216004 | | 8/1997 |
| JP | 2002 180166 | | 6/2002 |
| JP | 2002-210866 | | 7/2002 |
| JP | 2004-244671 | | 9/2004 |
| JP | 2006 291362 | | 10/2006 |
| JP | 2007 98599 | | 4/2007 |

OTHER PUBLICATIONS

"Anisotropy in plastic deformation of extruded magnesium alloy sheet during tensile straining at high temperature;" David E Cipoletti, Allan F Bower, and Paul E Krajewski; Integrating Materials and Manufacturing Innovation 2013, 2:4.*

Xinsheng Huang "Improvement of stretch formability of pure titanium sheet by differential speed rolling" Scripta Materialia 63 (2010) 473-476.*

International Search Report issued Jan. 26, 2010 in PCT/JP09/70689 filed Dec. 10, 2009.

The Extended European Search Report dated Mar. 21, 2012, in Application No. / Patent No. 09831947.8-1215 / 2357265 PCT/JP2009070689.

* cited by examiner

TITANIUM OR TITANIUM ALLOY PLATE EXCELLENT IN BALANCE BETWEEN PRESS FORMABILITY AND STRENGTH

This application is a National Stage of PCT/JP09/070689 filed Dec. 10, 2009 and claims the benefit of JP 2008-317041 filed Dec. 12, 2008 and JP 2009-117844 filed May 14, 2009.

TECHNICAL FIELD

The present invention relates to titanium or titanium alloy plates which are useful as materials for heat exchangers and chemical processing plants. More specifically, the present invention relates to titanium or titanium alloy plates which excel in press formability while surely having a predetermined strength.

BACKGROUND ART

Titanium or titanium alloy plates (hereinafter also representatively referred to as "titanium plate(s)") have excellent corrosion resistance and satisfactory specific strength (specific intensity) and have been recently used as materials for exchangers and chemical processing plants. In particular, titanium plates have been widely used for heat exchangers using seawater, because they are free from corrosion by the action of seawater.

Plate-type heat exchangers are one of major applications of titanium plates. The titanium plates adopted to these applications desirably have such satisfactory press formability as to be formed into complicated shapes, for higher efficiency of heat transfer (heat-transfer efficiency). In addition, these titanium plates should have such high strengths as to allow the heat exchangers to be operated under higher operation pressure. However, strength and press formability are opposing properties, and no titanium plate satisfying the two properties has been obtained yet.

To improve press formability in metallic plates such as steel sheets, techniques are employed for improving the property typically by alloy design and structure control for optimizing, for example, the aggregate structure and grain size. In addition to these techniques, techniques for applying a lubrication film to the surface of a steel sheet are known, as disclosed typically in PTL 1 and PTL 2. The press formability is improved according to these techniques by forming the lubrication film on the surface of the steel sheet and thereby allowing the steel sheet to deform and to fit a die.

The respective techniques also indicate the application of the formation of a lubrication film to a titanium plate as the metallic plate. Independently, PTL 3 and PTL 4, for example, disclose that when a lubrication film is applied to a steel sheet and the original steel sheet is controlled to have a r value and an elongation at specific levels or higher, the lubrication film may exhibit effects. PTL 3 and 4 mention that the formability is generally improved with an increasing elongation and an increasing r value, and describe that a steel sheet with better formability can exhibit further better formability by applying a lubrication film to the steel sheet. However, the present inventors investigated on the influence of a lubrication film on press formability of a titanium plate and found that satisfactory formability is not always obtained by forming a lubrication film on the surface of a titanium thin plate which merely has a high elongation and a high r value and shows good formability.

Specifically, the titanium plate has a crystal structure of close-packed hexagonal lattice (hcp) and is known to have larger anisotropic aspect in properties thereof than that of steel sheets and other metallic plates. Titanium plates manufactured by rolling a material in one direction show properties which significantly differ between the rolling direction (hereinafter also referred to as "L direction") and a direction perpendicular to the rolling direction (hereinafter also referred to as "T direction"). There are specific characteristics seen only in the titanium plates. Typically, the titanium plates have a yield strength (YS) in the L direction lower than that in the T direction by approximately 20% or more and have an elongation in the L direction higher than that in the T direction by approximately 40% or more. Probably owing to differences in characteristics between the titanium plates and the steel sheets, the techniques, which are believed to be effective for steel sheets, do not effectively exhibit their effects when merely applied to the titanium plates without modification.

PTL 1: Japanese Patent No. 3056446

PTL 2: Japanese Unexamined Patent Application Publication No. 2004-232085

PTL 3: Japanese Unexamined Patent Application Publication No. 2003-65564

PTL 4: Japanese Patent No. 3639060

DISCLOSURE OF INVENTION

Technical Problem

The present invention has been made while focusing attention on the above circumstances, and an object of the present invention is to provide a titanium or titanium alloy plate which is excellent in balance between press formability and strength and is useful as materials for heat exchangers and chemical processing plants.

Solution to Problem

The present invention achieves the object and provides a titanium or titanium alloy plate including a titanium or titanium alloy base plate having been rolled in one direction; and a lubrication film applied on a surface of the titanium or titanium alloy base plate, in which the surface of the lubrication film has a coefficient of sliding friction controlled to less than 0.15, the titanium or titanium alloy base plate has an elongation in the rolling direction (L-El) and a r value in a direction perpendicular to the rolling direction (T-r), and the L-El and T-r satisfy following Expression (1):

$$(T\text{-}r)/(L\text{-}El) \geq 0.07 \quad (1)$$

The titanium or titanium alloy plate according to the present invention preferably has a thickness of the base plate of about 0.3 to 1.0 mm.

In one specific embodiment, the lubrication film is an alkali-soluble lubrication film formed from a surface-treating composition, and the surface-treating composition contains a copolymer (A); a colloidal silica (B); and a wax mixture (C), in which the copolymer (A) is synthesized from monomer components including a constitutional unit (A-1) derived from an α,β-ethylenically unsaturated carboxylic acid, and a constitutional unit (A-2) derived from an α,β-ethylenically unsaturated carboxylic acid ester, the colloidal silica (B) has a particle size of 40 to 50 nm, and the wax mixture (C) contains a spherical polyethylene wax having an average particle size of 1 μm and a spherical polyethylene wax having an average particle size of 0.6 μm.

The wax mixture (C) preferably contains the spherical polyethylene wax having an average particle size of 0.6 μm in a content of 30 to 50 percent by mass based on the total mass (100 percent by mass) of the spherical polyethylene wax having an average particle size of 1 μm and the spherical polyethylene wax having an average particle size of 0.6 μm.

The spherical polyethylene wax having an average particle size of 1 μm and the spherical polyethylene wax having an average particle size of 0.6 μm preferably have softening points respectively in the range of 113° C. to 132° C.

In a preferred embodiment, the surface of the alkali-soluble lubrication film has a coefficient of static friction and a coefficient of sliding friction of each 0.15 or less, and a value obtained by subtracting the coefficient of sliding friction from the coefficient of static friction falls in the range of −0.02 to +0.02.

In another preferred embodiment, the surface-treating composition contains the copolymer (A) in a content of 70 to 90 percent by mass, the colloidal silica (B) in a content of 5 to 20 percent by mass, and the wax mixture (C) in a content of 3.5 to 10 percent by mass, based on the total mass (100 percent by mass) of the copolymer (A), the colloidal silica (B), and the wax mixture (C).

In yet another preferred embodiment, the constitutional unit (A-1) in the copolymer (A) derived from an α,β-ethylenically unsaturated carboxylic acid is a constitutional unit derived from methacrylic acid, and the constitutional unit (A-1) derived from an α,β-ethylenically unsaturated carboxylic acid occupies 20 to 40 percent by mass of the total mass (100 percent by mass) of the constitutional unit (A-1) derived from an α,β-ethylenically unsaturated carboxylic acid and the constitutional unit (A-2) derived from an α,β-ethylenically unsaturated carboxylic acid ester.

The copolymer (A) preferably has an acid value of 150 mgKOH/g or more.

The alkali-soluble lubrication film is preferably coated in a mass of coating of 0.6 to 1.5 $g/m^2$.

Advantageous Effects of Invention

The present invention provides a titanium or titanium alloy plate which is excellent in balance between press formability and strength, by applying a lubrication film to the surface of the titanium or titanium alloy base plate and controlling the titanium or titanium alloy base plate to have an elongation in the rolling direction (L-El) and a r value in a direction perpendicular to the rolling direction (T-r) both satisfying the predetermined relationship between them. The resulting titanium or titanium alloy plate is very useful as materials for heat exchangers and chemical processing plants.

BEST MODES FOR CARRYING OUT THE INVENTION

Figure 1:
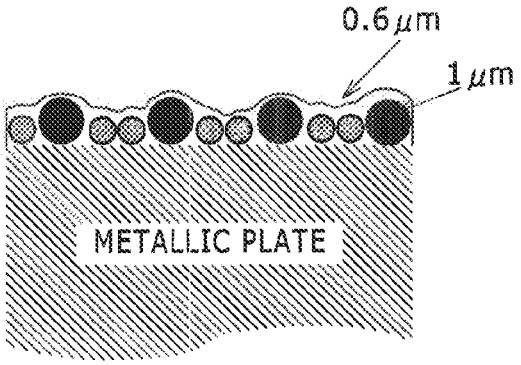
FIG. 1 is a diagram schematically illustrating how waxes are present in a lubrication film for use in the present invention.

The present inventors made intensive investigations from various viewpoints about how a lubrication film affects on the press formability of a titanium or titanium alloy plate and obtained the following findings. The present inventors initially found that, the titanium plate, if having higher surface lubricity, may contrarily have poor press formability because the titanium plate becomes susceptible to plastic deformation in the T direction where the ductility is low; and that the base plate should be controlled to be resistant to deformation in the T direction so as to improve press formability effectively by increasing the lubricity. The present inventors further found an idea that a Lankford value (r value) is chosen as an index of deformation in the T direction; and that the titanium or titanium alloy base plate as the material becomes resistant to deformation in the T direction when having a r value in the T direction at a certain high level.

The r value (Lankford value) is expressed as the ratio ($\gamma=\epsilon w/\epsilon t$) of the logarithmic strain $\epsilon w$ in the cross direction (corresponding to the L direction in the present invention) to the logarithmic strain $\epsilon t$ in the through-thickness direction both measured in a uniaxial tensile test. It is known that the limiting drawing ratio increases with an increasing r value. Namely, with an increasing r value, the plate in a die portion, which receives the load, becomes resistant to thinning.

In contrast, if a titanium plate is not coated on its surface with a lubrication film but is imparted with such lubricity as that of a regular press oil, the titanium plate has better press formability with an increasing elongation in the L direction (L-El). However, if the titanium plate has a highly lubricant surface as that of a lubrication film, the titanium plate becomes susceptible to macroscopic drifting or displacement, to cause a larger homogeneous deformation area. The stress thereby concentrates in such a relatively large area as not to be covered by local deformation and forms a large high-plastic-strain area. This contrarily leads to larger cracking than that in a titanium plate without lubrication film. In this connection, if a very small high-plastic-strain area is formed in a region with such a frictional resistance as of the press oil, the local deformation protects the area from cracking.

The present inventors further found that, to avoid these circumstances, high ductility (high elongation capacity) in the L direction (namely, low strength in the L direction) is not so desirable; and that plastic strain in the T direction should be enhanced to some extent by lowering the elongation in the L direction to some extent and thereby increasing the strength in the L direction to some extent.

The present inventors made further investigations based on these findings and have found that a titanium plate coated with a lubrication film may ensure satisfactory press formability while ensuring certain strength by controlling the titanium base plate itself to have a ratio [(T-r)/(L-El)] of the r value in the T direction (T-r) to the elongation in the L direction (L-El) to be within a predetermined range. The present invention has been made based on these findings. Specifically, the titanium plate coated with the lubrication film may exhibit excellent press formability, when the elongation in the rolling direction (L-El) and the r value in a direction perpendicular to the rolling direction (T-r) satisfy following Expression (1). The right side (lower limit) of Expression (1) is preferably 0.08. Though not critical, the upper limit of the ratio ((T-r)/(L-El)) is about 0.2 in consideration of tensile properties and manufacturing conditions of titanium.

$$(T\text{-}r)/(L\text{-}El) \geq 0.07 \quad (1)$$

According to the present invention, the above-mentioned advantageous effects are exhibited by controlling the ratio of r value (T-r) in a direction perpendicular to the rolling direction (T direction) to the elongation in the rolling direction (L direction) (L-El), as is described above. Though the rages of the respective parameters [elongation (L-El) and r value (T-r)] themselves are not critical, the elongation (L–EL) is preferably 50% or less, and the r value (T-r) is preferably 1.8 or more in consideration of tensile properties and manufacturing conditions of titanium.

The elongation (L-El) may be controlled by changing the final annealing temperature to thereby modify the growth of grains in size. In general, the final annealing temperature is about 750° C. to 800° C., but the elongation in the L direction may be lowered by setting the final annealing temperature to be relatively low (for example, about 700° C.).

In laboratory scale, the annealing of titanium may be performed as vacuum annealing in which annealing is performed in a vacuum atmosphere or an atmosphere obtained through evacuation and argon (Ar) purge, without subsequent acid wash. However, in industrial scale where productivity is weighed, the annealing is generally performed as annealing in an air atmosphere for about 10 minutes, followed by acid wash.

The r value in the T direction (T-r) may be controlled by adjusting the number of rolling passes (rolling drafts) in cold rolling (in a regular rolling direction). Specifically, according to a regular procedure, two cold rolling passes each with a rolling reduction of about 50% to 75% are performed; and the r value (T-r) may be controlled by increasing or decreasing the number of passes of the cold rolling. In consideration of aggregate structure, the r value increases with an increasing accumulation of the (0001) plane of crystal in parallel with the plate thickness. This is because a glide plane of titanium is preferentially generated in the (0001) plane. In addition, the r value may be controlled by increasing the number of cold rolling passes, because the cold rolling helps the aggregate structure with a high r value, i.e., the (0001) plane of crystal, accumulates in parallel with the plate plane.

By allowing the r value in the T direction (T-r) and the elongation in the L direction (L-El) to satisfy the condition represented by Expression (1), the titanium plate can exhibit satisfactory formability while maintaining certain strength. This is probably because a suitable deformation may be ensured without lowering the strength by balancing the elongation in the L direction (L-El) and the r value in the T direction (T-r), though not all the deformation behavior of such a titanium plate, which has especially high anisotropic aspect, during press forming is analyzed and grasped.

The titanium plate according to the present invention is designed on the precondition that it has a highly lubricant film (coating) on the surface thereof, and the advantages obtained by specifying the condition represented by Expression (1) are significantly exhibited as the titanium plate has high lubricity. Specifically, the lubrication film should have a coefficient of sliding friction of less than 0.15 in order to effectively exhibit formability-improving effects obtained through the formation of the lubricant film (lubrication film) by satisfying the condition represented by Expression (1) (see FIG. 4 mentioned later). The lubrication film, if having a coefficient of sliding friction of 0.15 or more, may not exhibit the above effects, because this impedes sufficient migration of the material and impedes the improvement of macroscopic uniformity. The coefficients of sliding friction hereinafter are measured according to the same procedure.

Materials for forming the lubrication film may be any of known or customary materials. Among them, Organic-based resins mainly including, for example, polyurethane resins and polyolefin resins, may be suitably used (see after-mentioned Examples). The lubrication film may further contain an inorganic silica-based solid lubricant. However, the lubricant, if contained in an excessively high content, may cause the surface of the lubrication film to have a high coefficient of sliding friction. To avoid this, the content of the lubricant is preferably controlled within such a range as to exhibit satisfactory lubricity (namely, to minimize the coefficient of sliding friction). Although the coefficient of sliding friction on the surface of the lubrication film is basically determined to some extent by the type of the resin film (lubrication film), the coefficient of sliding friction may somewhat vary depending on the surface quality (surface unevenness or roughness) of the titanium base plate even in lubrication films of the same type.

Next, a lubrication film used particularly preferably in the present invention will be illustrated. The lubrication film is an alkali-soluble lubrication film formed from a surface-treating composition, in which the surface-treating composition includes a copolymer (A); a colloidal silica (B); and a wax mixture (C), the copolymer (A) is synthesized from monomer components including a constitutional unit (A-1) derived from an α,β-ethylenically unsaturated carboxylic acid; and a constitutional unit (A-2) derived from an α,β-ethylenically unsaturated carboxylic acid ester, the colloidal silica (B) has a particle size of 40 to 50 nm, and the wax mixture (C) contains a spherical polyethylene wax having an average particle size of 1 μm and a spherical polyethylene wax having an average particle size of 0.6 μm.

The wax mixture (C) preferably contains the spherical polyethylene wax having an average particle size of 0.6 μm in a content of 30 to 50 percent by mass based on the total mass (100 percent by mass) of the spherical polyethylene wax having an average particle size of 1 μm and the spherical polyethylene wax having an average particle size of 0.6 μm. These spherical polyethylene waxes preferably have softening points respectively in the range of 113° C. to 132° C.

In a preferred embodiment, the surface of the alkali-soluble lubrication film has a coefficient of static friction and a coefficient of sliding friction of each 0.15 or less, and a value obtained by subtracting the coefficient of sliding friction from the coefficient of static friction falls in the range of −0.02 to +0.02.

In another preferred embodiment, the surface-treating composition includes the copolymer (A) in a content of 70 to 90 percent by mass, the colloidal silica (B) in a content of 5 to 20 percent by mass, and the wax mixture (C) in a content of 3.5 to 10 percent by mass, based on the total mass (100 percent by mass) of the copolymer (A), the colloidal silica (B), and the wax mixture (C). In yet another preferred embodiment, the constitutional unit (A-1) derived from an α,β-ethylenically unsaturated carboxylic acid in the copolymer (A) is a constitutional unit derived from methacrylic acid, and the constitutional unit (A-1) derived from an α,β-ethylenically unsaturated carboxylic acid occupies 20 to 40 percent by mass of the total mass (100 percent by mass) of the constitutional unit (A-1) derived from an α,β-ethylenically unsaturated carboxylic acid and the constitutional unit (A-2) derived from an α,β-ethylenically unsaturated carboxylic acid ester. In still another preferred embodiment, the copolymer (A) has an acid value of 150 mgKOH/g or more. In another preferred embodiment, the alkali-soluble lubrication film is coated in a mass of coating of 0.6 to 1.5 $g/m^2$.

The respective components of the lubrication film will be illustrated in detail below.

[Copolymer (A) for Lubrication Film]

The metallic plate coated with an alkali-soluble lubrication film (titanium plate coated with an alkali-soluble lubrication film) according to the present invention includes the titanium base plate and, formed on one or both sides thereof, a lubrication film. The lubrication film is a film or coating obtained from a surface-treating composition containing a copolymer (A) as a resin component. The copolymer (A) essentially contains a constitutional unit (A-1) derived from an α,β-ethylenically unsaturated carboxylic acid and a constitutional unit (A-2) derived from an α,β-ethylenically unsaturated carboxylic acid ester.

The constitutional unit (A-1) derived from an α,β-ethylenically unsaturated carboxylic acid is used for introducing carboxyl groups into the copolymer (A), whereby helps the copolymer (A) to have a higher solubility in an alkaline aqueous solution, and helps the lubrication film to have higher film removability. Examples of the α,β-ethylenically unsaturated carboxylic acid for the formation of the constitutional unit (A-1) include, but are not limited to, monocarboxylic acids such as acrylic acid, methacrylic acid, crotonic acid, and isocrotonic acid; dicarboxylic acids such as maleic acid, fumaric acid, and itaconic acid; and monoesters of such dicarboxylic acids. Each of these may be used alone or in combination. Among them, methacrylic acid is most preferred.

The content of the constitutional unit (A-1) is preferably 20 to 40 percent by mass based on the total mass (100 percent by mass) of the constitutional unit (A-1) and the constitutional unit (A-2). Specifically, the α,β-ethylenically unsaturated carboxylic acid preferably occupies 20 to 40 percent by mass of the total monomer components (100 percent by mass) for use in the preparation of the copolymer (A). If the unsaturated carboxylic acid is used in a content of less than 20 percent by mass, the lubrication film may show insufficient film removability in alkali. In contrast, the unsaturated carboxylic acid, if used in a content of more than 40 percent by mass, may give a lubrication film which has poor strength and is susceptible to peeling off during press working, thus being undesirable. The content of the constitutional unit (A-1) is more preferably 25 to 35 percent by mass.

The copolymer (A), when containing the constitutional unit (A-1) in a content within the above range, has an acid value of about 150 to 300 mgKOH/g. The acid value within this range corresponds to about 2.69 to 5.37 mmol of carboxyl groups per 1 g of the copolymer (A). The copolymer (A) more preferably has an acid value in the range of 150 to 250 mgKOH/g.

The constitutional unit (A-2) derived from an α,β-ethylenically unsaturated carboxylic acid ester acts as a base for the copolymer (A) and affects the adhesion of the lubrication film to the metallic plate (titanium plate) and the lubricity. In addition, the constitutional unit (A-2) is an ester, is thereby hydrolyzed by the action of an alkaline aqueous solution, and may also contribute to the removability of the lubrication film.

The α,β-ethylenically unsaturated carboxylic acid ester for the formation of the constitutional unit (A-2) is not limited, and examples thereof include acrylic acid esters such as methyl acrylate, ethyl acrylate, butyl acrylate isomers (e.g., i-butyl acrylate), 2-ethylhexyl acrylate, isooctyl acrylate, isononyl acrylate, isobornyl acrylate, N,N-dimethylaminoethyl acrylate, 2-methoxyethyl acrylate, 3-methoxybutyl acrylate, 2-hydroxyethyl acrylate, 2-hydroxypropyl acrylate, 4-hydroxybutyl acrylate, lauryl acrylate, n-stearyl acrylate, tetrahydrofurfuryl acrylate, trimethylolpropane acrylate, and 1,9-nonanediol acrylate; and methacrylic acid esters such as methyl methacrylate, ethyl methacrylate, butyl methacrylate isomers (e.g., n-butyl methacrylate, i-butylmethacrylate, and t-butyl methacrylate), 2-ethylhexyl methacrylate, lauryl methacrylate, stearyl methacrylate, tridecyl methacrylate, cyclohexyl methacrylate, benzyl methacrylate, isobornyl methacrylate, glycidyl methacrylate, tetrahydrofurfuryl methacrylate, allyl methacrylate, 2-hydroxyethyl methacrylate, hydroxypropyl methacrylate, 2-methoxyethyl methacrylate, 2-ethoxyethyl methacrylate, ethylene glycol dimethacrylate, triethylene glycol dimethacrylate, 1,3-butylene glycol dimethacrylate, 1,6-hexanediol dimethacrylate, polypropylene glycol dimethacrylate, trimethylolpropane trimethacrylate, dimethylaminoethyl methacrylate, diethylaminoethyl methacrylate, trifluoroethyl methacrylate, and heptadecafluorodecyl methacrylate. Each of these may be used alone or in combination. Among them, monofunctional monomers are preferred, of which ethyl (meth)acrylates, 2-ethylhexyl (meth)acrylates, and n-butyl (meth)acrylates are typically preferred.

The copolymer (A) may be synthetically prepared by further using another monomer in addition to the monomers for constituting the constitutional unit (A-2). However, the copolymer (A) preferably includes the constitutional unit (A-1) and the constitutional unit (A-2) alone in consideration of the adhesion to the metallic plate (titanium plate), and the flexibility, lubricity, or film removability of the lubrication film. For this reason, the constitutional unit (A-2) preferably occupies 60 to 80 percent by mass of the total mass (100 percent by mass) of the copolymer (A). More specifically, the surface-treating composition preferably contains one or more unsaturated carboxylic acids for the constitutional unit (A-1) in a content of 20 to 40 percent by mass; and one or more unsaturated carboxylic acid esters for the constitutional unit (A-2) in a content of 60 to 80 percent by mass, based on the total mass (100 percent by mass) of the unsaturated carboxylic acids and the unsaturated carboxylic acid esters.

Though not limited, the copolymer (A) is preferably synthesized through emulsion polymerization, because this technique easily gives an aqueous surface-treating composition and is thus environmentally friendly. The emulsion polymerization may be performed according to a known procedure. For example, the emulsion polymerization may be performed in water typically using ammonium persulfate or another water-soluble polymerization initiator, and an emulsifier. Though not limited, the emulsifier for use herein may be a reactive emulsifier intramolecularly having an ethylenically unsaturated group.

From the viewpoints of lubricity and film removability, the copolymer (A) has a number-average molecular weight of preferably 10,000 or more, more preferably 12,000 or more, and furthermore preferably 15,000 or more, and preferably 30,000 or less, more preferably 25,000 or less, and furthermore preferably 20,000 or less.

The copolymer (A) preferably has a glass transition temperature (Tg) of −40° C. to 100° C. The copolymer (A), if having a glass transition temperature (Tg) of lower than −40° C., may cause the lubricant film to have tackiness, thus causing troubles such as dust deposition or blocking. The copolymer (A), if having a glass transition temperature (Tg) of higher than 100° C., may cause the lubrication film to be fragile, thus causing peeling off of the film during press working.

The copolymer (A) is not neutralized in the surface-treating composition for use herein for the formation of the lubrication film. Accordingly, a basic compound is not added to the reaction mixture during emulsion polymerization, to the emulsion after the completion of the polymerization, and to the resulting surface-treating composition. It should be noted that the "basic compound" herein does not include the wax mixture (C), because an aqueous dispersion of the wax mixture (C) is basic. When the surface-treating composition is prepared using the emulsion after the completion of polymerization, the surface-treating composition has a pH in an acidic region of about 1.7 to about 4, due to the presence of carboxyl groups of the copolymer (A).

The content of the copolymer (A) in the surface-treating composition is preferably 70 to 90 percent by mass based on the total mass (100 percent by mass) of the copolymer (A), the colloidal silica (B; in terms of solids content), and the wax mixture (C). The copolymer (A), if contained in a content of less than 70 percent by mass, may cause the lubrication film to have poor film-formability or may fail to maintain or cover the wax mixture (C) within the lubrication film, thus being undesirable. In contrast, the copolymer (A), if contained in a content of more than 90 percent by mass, may cause the lubrication film to have insufficient lubricity and may invite problems such as peeling off of the film during press forming. This is because the contents of the silica (B) and the wax mixture (C) become relatively small.

[Colloidal Silica (B) for Lubrication Film]

The surface-treating composition is used for the formation of the lubrication film in the metallic plate (titanium plate) coated with an alkali-soluble lubrication film according to the present invention. The composition contains a colloidal silica (B) as an essential component. The colloidal silica (B) is contained for better press formability. The colloidal silica (B) for use in the present invention is one having a particle size of 40 to 50 nm. A colloidal silica having a particle size of less than 40 nm has an excessively large specific surface area and excessively high activity, may thereby aggregate in the surface-treating composition to impair the storage stability of the composition, and may cause the lubrication film to have insufficient film removability in alkali, thus being undesirable. A colloidal silica having a particle size of more than 50 nm may precipitate during storage of the surface-treating composition and may become difficult to be re-dispersed even when agitated, thus being undesirable. In addition, even a trace amount of precipitates impairs the press formability. For these reasons, the colloidal silica (B) is preferably one having a particle size of 40 to 50 nm.

The colloidal silica (B) is preferably acidic, because the surface-treating composition for use in the present invention is acidic and has a pH of about 1.7 to 4. A basic (alkaline) colloidal silica, if used, may cause gelation during the preparation of the surface-treating composition. Such a colloidal silica (B) having a particle size of 40 to 50 nm and being acidic is available typically as "SNOWTEX (registered trademark) OL" from Nissan Chemical Industries, Ltd. The "particle size" herein is an average particle size determined according to the Brunauer-Emmett-Teller (BET) method.

The colloidal silica (B) in the surface-treating composition is preferably contained in a content (solids content) of 5 to 20 percent by mass based on the total mass (100 percent by mass) of the copolymer (A), the colloidal silica (B), and the wax mixture (C). The wax mixture (C), if contained in a content of less than 5 percent by mass, may not sufficiently act to improve the film removability and press formability. The wax mixture (C), if contained in a content of more than 20 percent by mass, may tend to cause poor press formability of the resulting titanium plate and poor stability of the surface-treating composition, thus being undesirable.

[Wax Mixture (C) for Lubrication Film]

The surface-treating composition for the formation of the lubrication film in the metallic plate (titanium plate) coated with an alkali-soluble lubrication film according to the present invention contains a wax mixture (C). The wax mixture (C) for use herein is a mixture of a spherical polyethylene wax having an average particle size of 1 μm (hereinafter also referred to as "wax (C-1)") and another spherical polyethylene wax having an average particle size of 0.6 μm (hereinafter also referred to as "wax (C-2)"). The two types of waxes are used in combination as a mixture as illustrated in FIG. 1. This is because the wax (C-1) having an average particle size of 1 μm forms protrusions in the surface of the lubrication film to increase the lubricity of the surface, and the wax (C-2) having an average particle size of 0.6 μm, which is embedded in the film, exhibits lubrication effects when the metallic plate migrates into a die cavity during press forming. The surface-treating composition, if containing only one of the two types of waxes, shows insufficient press formability. The surface-treating composition, if containing a wax having an average particle size of more than 1 μm, gives a lubrication film with poor lubrication effects. For these reasons, the specific two types of waxes are used in combination in the present invention. In this connection, fluorine lubricants, if used, show not satisfactory lubrication effects. It should be noted that the average particle size of 1 μm and the average particle size of 0.6 μm are schematic values in which variations upon production are accepted.

As is described above, in a preferred embodiment of the present invention, the wax (C-1) having an average particle size larger than the film thickness is used in combination with the wax (C-2) having an average particle size smaller than the film thickness. According to this embodiment, the wax (C-1) exhibits initial lubricity when the metallic plate migrates into the die cavity, and the wax (C-2) exhibits lubricity in sliding of the metallic plate, which has migrated into the cavity, with the die. The film thickness will be described later.

As is illustrated in FIG. 1, the wax (C-1) and the wax (C-2) for use in the present invention should remain spherical in the lubrication film. If the waxes melt and bleed out to the surface of the lubrication film during press forming, the effects obtained by the combination use of the two types of waxes may not be exhibited. The metallic plate is heated to 120° C. to 130° C. by the action of heat of friction with the die during press forming. Accordingly, the waxes (C-1) and (C-2) herein are preferably polyethylene waxes respectively having softening points of 113° C. to 132° C. This allows press forming to be performed in an area in which solid lubrication and liquid lubrication occurs in combination to show most excellent lubricity.

The wax (C-1) may be available typically as CHEMIPEARL (registered trademark) "WF-640" (softening point of 113° C.) and CHEMIPEARL "W-700" (softening point of 132° C.) from Mitsui Chemicals Inc.; and the wax (C-2) may be available as CHEMIPEARL "W-950" (softening point of 113° C.) and CHEMIPEARL "W-900" (softening point of 132° C.) from Mitsui Chemicals Inc. These products are aqueous dispersions of wax particles. The average particle sizes of the waxes are measured according to the coulter counter method, and the softening points thereof are measured according to the ball and ring method.

The blend ratio of the wax (C-1) and the wax (C-2) is preferably such that the wax mixture (C) contains 50 to 70 percent by mass of the wax (C-1) and 30 to 50 percent by mass of the wax (C-2), based on the total mass (100 percent by mass) of the waxes (C-1) and (C-2). Each of these contents is indicated in terms of solids content. The wax (C-2), if present in a content of less than 30 percent by mass, may not sufficiently exhibit its lubricating effects inside the film. This may cause insufficient lubricity in a depth direction (through-thickness direction) of the film and thereby cause peeling off (cohesive failure in the sliding direction) of the film due to die sliding. In contrast, the wax (C-2), if present in a content of more than 50 percent by mass, may cause insufficient lubricating effects in the film surface and thereby cause lower press formability, because the relative amount of the wax (C-1) becomes small.

The content of the wax mixture (C) in the surface-treating composition is preferably 3.5 to 10 percent by mass, based on the total mass (100 percent by mass) of the copolymer (A), the colloidal silica (B), and the wax mixture (C). With an increasing wax content in the lubrication film, the coefficient of sliding friction significantly decreases at a wax content of about 1 percent by mass; substantially levels off at 3.5 percent by mass; gradually decreases thereafter; and becomes constant at about 10 percent by mass. For this reason, the content of the wax mixture (C) is preferably 3.5 percent by mass or more, and more preferably 5 percent by mass or more. The upper limit of the content is preferably 10 percent by mass, because, if the wax mixture (C) is present in a content of more than 10 percent by mass, the effects of lowering the coefficient of sliding friction are saturated. In addition, the wax mixture (C), if present in excess, may cause significant foaming during coating of the surface-treating composition to the metallic plate and thereby impede the formation of a homogeneous film. This is probably because of the presence of surfactants in the aqueous dispersions of waxes. The content of the wax mixture (C) is more preferably 8 percent by mass or less.

The combination use of the two types of waxes as described above allows the lubrication film of the metallic plate (titanium plate) coated with an alkali-soluble lubrication film according to the present invention to have a coefficient of static friction and a coefficient of sliding friction which are approximate to each other. Specifically, in a preferred embodiment, the lubrication film has a coefficient of static friction and a coefficient of sliding friction of each 0.15 or less, and a value obtained by subtracting the coefficient of sliding friction from the coefficient of static friction falls in the range of −0.02 to +0.02. The lubrication film, when having the parameters within the above-specified ranges, shows a smaller resistance until the metallic plate migrates into the die cavity and undergoes elongation. In addition, the coefficient of static friction and the coefficient of sliding friction being substantially in the same range further suppresses forming defects (necking and cracking) due to the difference in elongation percentage between the rolling direction and the cross direction during press forming. The resulting titanium plate can be processed even through press forming into a complicated shape such as a plate-type heat exchanger.

[Mass of Coating of Lubrication Film]

It is difficult to indicate the thickness of the lubrication film merely by, for example, micrometers, because the lubrication film herein has protrusions of the wax (C-1) having a larger average particle size, as illustrated in FIG. 1. To form protrusions of the wax (C-1) having an average particle size of 1 μm in the film surface as illustrated in FIG. 1, the film is preferably coated in a mass of coating of 0.6 to 1.5 g/m$^2$. The lubrication film, if coated in a mass of coating of less than 0.6 g/m$^2$, may not sufficiently exhibit lubricity, and this may cause peeling off of the film and thereby cause galling and cracking. In contrast, the lubrication film, if coated in a mass of coating of more than 1.5 g/m$^2$, may have insufficient film removability in alkali and may lower the pH of an alkaline degreaser to thereby impede the action of the degreaser, thus being undesirable.

[Surface-Treating Composition]

The surface-treating composition for use in the present invention may be prepared, for example, by synthesizing the copolymer (A) through emulsion polymerization to give an emulsion; and mixing the emulsion thoroughly with the colloidal silica (B) as an aqueous dispersion and with an aqueous dispersion of the wax mixture (C), namely, an aqueous dispersion of the wax (C-1) and an aqueous dispersion of the wax (C-2). The resulting surface-treating composition may be diluted or concentrated so as to have a suitable viscosity for coating.

The surface-treating composition may further contain any of known additives for use in resin-coated metallic plates, such as titanium oxide and other pigments, delustering agents, rust inhibitors, and anti-setting agents.

The way to apply the surface-treating composition to the base plate is not limited and can be any of coating procedures such as coating with a bar coater, coating with a roll coater, spraying, and coating with a curtain flow coater. The coated film is then dried. However, drying through heating at excessively high temperatures should be avoided to allow the wax mixture (C) to remain as particles. Specifically, drying is preferably performed through heating at 100° C. to 130° C. The base plate may have been subjected to a known surface treatment (surface preparation) such as chromate treatment, chromate free treatment, or phosphate treatment. The surface treatment is performed as intended to improve the corrosion resistance and to improve the adhesion to the lubrication film.

The titanium alloy according to the present invention is adopted as materials for heat exchangers and chemical processing plants and, when adopted to these materials, allows the materials to show more satisfactory press formability. However, the titanium plate, if having an excessively large plate thickness, may insufficiently exhibit improved formability due to coating of the lubrication film. Specifically, when the titanium plate is coated with a lubrication film, with an increasing plate thickness, the stress concentrates and thereby forms a larger high-plastic-strain area in such a relatively larger region as not to be covered by local deformation. This causes larger cracking than that of a titanium plate without lubrication film. In this connection, if a very small high-plastic-strain area is formed in a region with such a frictional resistance as of the press oil, the local deformation protects the area from cracking. For these reasons, the titanium plate preferably has a gauge (thickness) of 1.0 mm or less.

The lower limit of the thickness of the titanium plate (or titanium alloy plate) may be set in consideration typically of the required strength and may vary depending on the type of the titanium or titanium alloy plate. Typically, in the case of an industrial pure titanium (Japanese Industrial Standards (JIS) Grade 1 or Grade 2), the lower limit of the thickness is preferably about 0.3 mm. In the case of a titanium alloy containing a small amount of alloy element(s), the thickness may be smaller than the above-mentioned lower limit of the pure titanium plate.

Titanium plates to which the present invention is applied are basically intended to be plates of industrial pure titanium (JIS Grade 1 or Grade 2). The titanium plates are further improved in press formability, which property is required when such industrial pure titanium is adopted to members for heat exchangers and chemical processing plants. However, titanium alloys containing small amounts of alloy elements within ranges not adversely affecting the press formability are also included in titanium alloys to which the present invention is applied. For example, the addition of elements such as Al, Si, and Nb is effective for increasing the strength of the titanium plate (namely, titanium alloy plate). However, these elements, if contained in excess, may cause excessively high strength and may thereby inhibit the titanium plate to have satisfactory press formability as expected in the present invention. To avoid this, the content (total content of one or more elements) of these elements is preferably up to about 2%. Iron (Fe) is contained as an inevitable impurity in titanium or titanium alloy base plates. However, the present invention may also be adopted to a titanium alloy plate positively containing up to about 1.5% of Fe and thereby having higher strength.

The titanium base plate or titanium alloy plate, to which the present invention is applied, contains the above components, with the remainder including titanium and inevitable impurities. As used herein the term "inevitable impurities" refers to impurity elements inevitably contained in the material titanium sponge, and representative examples thereof include oxygen, iron (except for the case where Fe is positively added), carbon, nitrogen, hydrogen, chromium, and nickel. In addition, the inevitable impurities further include elements that may be taken into the product during manufacturing process, such as hydrogen. Of the impurities, oxygen and iron particularly affect the properties (tensile strength and elongation) of the titanium plate or titanium alloy plate, and these properties vary depending on the contents of oxygen and iron (see after-mentioned Tables 1 to 3). Regarding the contents of oxygen, iron, and other inevitable impurities, the oxygen content may be about 0.03 to 0.05 percent by mass; and the iron content may be about 0.02 to 0.04 percent by mass.

The present invention will be illustrated in further detail with reference to several working examples below. It should be noted, however, that these examples are never intended to limit the scope of the present invention; various alternations and modifications may be made without departing from the scope and spirit of the present invention and all fall within the scope of the present invention.

EXAMPLES

Titanium plates or titanium alloy plates having the chemical compositions given in Table 1 below were subjected to cold tolling so as to have predetermined thicknesses (0.5 to 1.5 mm). The titanium plates used were pure titanium plates corresponding to JIS Grade 1 and JIS Grade 2; and the titanium alloy plates used were a titanium alloy plate containing, for example, Al, Si, and Nb in a total content of 1.2% (indicated as "1.2ASN" in Table 1) and a titanium alloy plate containing Fe in a content of 1.5% (indicated as "1.5Fe titanium alloy" in Table 1. The titanium or titanium alloy plates were annealed in the air for 10 minutes and then subjected to acid wash treatment (washing with nitric and hydrofluoric acid). The plates of pure titanium corresponding to JIS Grade 1 were controlled to have a certain elongation in the L direction (L-El) by adjusting the annealing temperature and to have a certain r value in the T direction (T-r) by adjusting the chemical composition and the number of passes in cold rolling.

TABLE 1

| Titanium type | Chemical composition* (percent by mass) O | Fe | Al | Si | Nb | Remarks |
|---|---|---|---|---|---|---|
| A | 0.058 | 0.044 | — | — | — | JIS Grade 1 pure titanium |
| B | 0.041 | 0.027 | — | — | — | |
| C | 0.045 | 0.024 | — | — | — | |
| D | 0.048 | 0.021 | — | — | — | |
| E | 0.045 | 0.024 | — | — | — | |
| F | 0.045 | 0.024 | — | — | — | |
| G | 0.045 | 0.024 | — | — | — | |
| H | 0.089 | 0.066 | — | — | — | JIS Grade 2 pure titanium |
| I | 0.040 | 0.030 | 0.5 | 0.5 | 0.2 | 1.2ASN titanium alloy |
| J | 0.065 | 1.48 | — | — | — | 1.5Fe titanium alloy |

*The remainder including titanium and inevitable impurities

The obtained titanium or titanium alloy plates were coated with lubrication films mentioned below (mass of coating: 0.2 to 3.0 g/m$^2$). The annealing temperature, number of cold rolling operations, and plate thickness of the titanium plates or titanium alloy plates; the type of the lubrication films; and the coefficient of sliding friction of the surface of the lubrication films are shown in Table 2 below. It should be noted that even lubrication films of the same type may have different coefficients of sliding friction on the surface. This is because the coefficient of sliding friction is affected by the surface properties (surface unevenness or roughness) of the titanium or titanium alloy plates, as described above. The coefficients of sliding friction on the surface of the lubrication films as indicated in Table 2 were measured according to a method for measuring coefficient of friction mentioned later ((1) Coefficient of Friction in [Evaluation Methods]).

[Types of Lubrication Films]

Organic-based 1: 90 percent by mass of a polyurethane and 10 percent by mass of a colloidal silica Organic-based 2: 90 percent by mass of a polyolefin and 10 percent by mass of a colloidal silica Organic-based 3: 80 percent by mass of a polyolefin and 20 percent by mass of a colloidal silica Inorganic-based 1: 70 percent by mass of a colloidal silica, 25 percent by mass of a polyurethane, and 5 percent by mass of a polyolefin Inorganic-based 2: 60 percent by mass of a colloidal silica, 30 percent by mass of a polyurethane, and 10 percent by mass of a polyolefin

TABLE 2

| Test No. | Titanium type | Annealing temperature (° C.) | Number of passes in cold rolling (number) | Plate thickness (mm) | Lubrication film type | Coefficient of sliding friction of lubrication film surface |
|---|---|---|---|---|---|---|
| 1 | A | 700 | 2 | 0.5 | Organic-based 1 | 0.09 |
| 2 | A | 700 | 2 | 0.5 | Organic-based 2 | 0.14 |
| 3 | A | 700 | 2 | 0.5 | Inorganic-based 2 | 0.14 |

TABLE 2-continued

| Test No. | Titanium type | Annealing temperature (° C.) | Number of passes in cold rolling (number) | Plate thickness (mm) | Lubrication film type | Coefficient of sliding friction of lubrication film surface |
|---|---|---|---|---|---|---|
| 4 | B | 750 | 1 | 0.5 | Organic-based 1 | 0.08 |
| 5 | B | 750 | 1 | 0.5 | Organic-based 2 | 0.13 |
| 6 | B | 750 | 1 | 0.5 | Inorganic-based 2 | 0.14 |
| 7 | C | 800 | 3 | 0.5 | Organic-based 1 | 0.14 |
| 8 | C | 800 | 3 | 0.5 | Organic-based 2 | 0.13 |
| 9 | C | 800 | 3 | 0.5 | Inorganic-based 2 | 0.14 |
| 10 | E | 800 | 3 | 0.7 | Organic-based 1 | 0.12 |
| 11 | F | 800 | 3 | 1.0 | Organic-based 2 | 0.11 |
| 12 | G | 800 | 3 | 1.1 | Organic-based 1 | 0.12 |
| 13 | H | 750 | 2 | 0.5 | Organic-based 2 | 0.11 |
| 14 | I | 860 | 3 | 0.5 | Organic-based 1 | 0.08 |
| 15 | J | 750 | 2 | 0.5 | Organic-based 1 | 0.09 |
| 16 | C | 800 | 3 | 0.5 | Inorganic-based 1 | 0.15 |
| 17 | D | 900 | 1 | 0.5 | Organic-based 1 | 0.09 |
| 18 | D | 900 | 1 | 0.5 | Organic-based 2 | 0.14 |
| 19 | D | 900 | 1 | 0.5 | Inorganic-based 1 | 0.15 |
| 20 | A | 700 | 2 | 0.5 | Organic-based 3 | 0.16 |
| 21 | H | 750 | 2 | 0.5 | Inorganic-based 2 | 0.16 |
| 22 | I | 860 | 3 | 0.5 | Organic-based 3 | 0.17 |
| 23 | J | 750 | 2 | 0.5 | Organic-based 3 | 0.16 |

From the titanium or titanium alloy plates before coating of the lubrication film, specimens prescribed in the American Society for Testing and Materials (ASTM) standards were sampled, and the yield strength in the L direction (L-YS), tensile strength in the L direction (L-TS), total elongation (elongation in the L direction: L-El), and r value in the T direction (T-r) of the specimens were measured based on the tensile test method for metal materials prescribed in ASTM E8. For the measurements of yield strength (YS), tensile strength (TS), and elongation (L-El), the tensile tests were performed at a rate of testing of 0.5% per minute from the beginning to 0.5% strain, and at a rate of testing of 40% per minute thereafter. For the measurement of r value (T-r), the tensile tests were performed at an applied strain of 6% and at a rate of testing of 10% per minute to determine the r value (T-r).

The titanium or titanium plates coated with lubrication films were subjected to the evaluation of press formability according to the method mentioned later. In this process, an Erichsen value measurement, which is considered to be a regular evaluation method for press formability, was also performed, as a comparison or reference to the evaluation method employed in the present invention. As the measurement of the Erichsen value, specimens of a size of 90 mm wide and 90 mm long were sampled from the above-prepared titanium plates or titanium alloy plates coated with lubrication films, and subjected to Erichsen tests prescribed in JIS Z 2247. The evaluation method for press formability employed in the present invention is as follows.

The titanium or titanium alloy plates were respectively subjected to pressing using a 8-ton oil-hydraulic pressing machine and a die having a size of 100 mm long and 100 mm wide and having six ridge lines at a pitch of 10 mm, a maximum height of 4 mm, and radii of curvature R of 0.4, 0.6, 0.8, 1.0, 1.4, and 1.8 (mm). The resulting press-formed articles simulated a heat exchange part of a plate-type heat exchanger. The pressing was performed as a shear press of 4 mm under conditions of a maximum load of 300 N and press speed of 1 mm per second.

Figure 2:
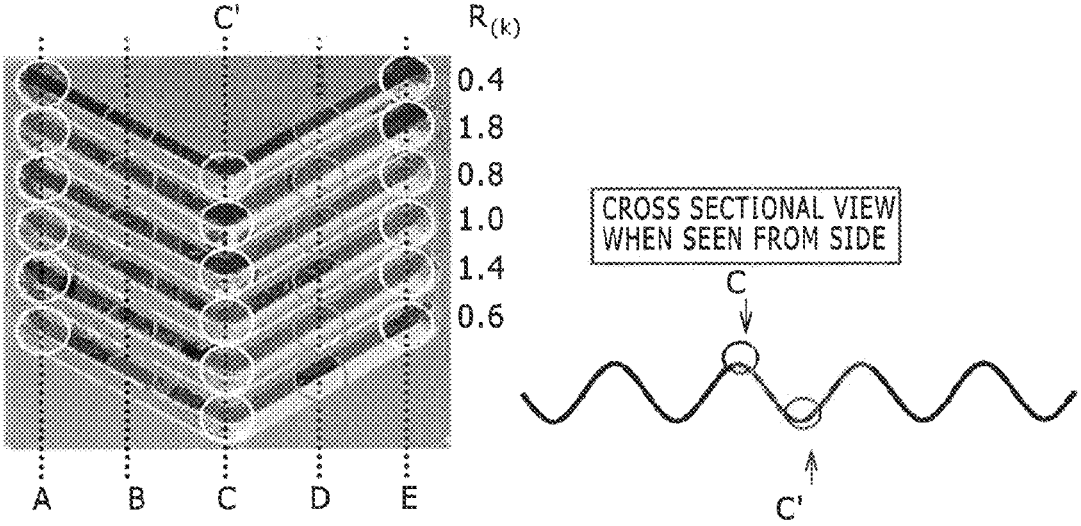
FIG. 2 is an explanatory drawing of evaluation points for press formability in the present invention.

Cracking of the above-prepared pressed specimens was measured at 36 points of intersection of the ridges with the broken lines illustrated in FIG. 2, in which FIG. 2(*a*) is a plan view and FIG. 2(*b*) is a cross-sectional view. Upon visual observation, a measurement point was rated as "2" when it showed no defect, was rated as "1" when it showed tendency of necking (necking or pinching phenomenon), and was rated as "0" when it suffered from cracking. For the measurement points A, C, C', and E which act as origins of cracking, the rate E (k) at each measurement point was determined by weighing the evaluated rate by 1.0 (Expression (2) below). For the measurement points B and D, the rate E (k) at each measurement point was determined by weighing the evaluated rate by 0.5 (Expression (3) below). In following Expressions (2) and (3), the symbol "k" represents the number of measurement point. The rate at each measurement point is multiplied by the reciprocal of the radius of curvature R (k) at that point to convert the cracking state into a numerical value. Then, a score is determined as an index for the evaluation of press forming in the present invention. The score is the ratio between the total sum of the measured values of cracking state at all the measurement points and the total sum of values of cracking state at all the measurement points which values are determined provided that no crack is generated at all the measurement points (Expression (4) below). In the right hand side of Expression (4), the first term in the denominator relates to data of the measurement points A, C, C', and E; and the second term in the denominator relates to data of the measurement points B and D.

$$E(k)=1.0\times(\text{rate; without defect: 2, necking: 1, crack generation: 0}) \quad (2)$$

$$E(k)=0.5\times(\text{rate; without defect: 2, necking: 1, crack generation: 0}) \quad (3)$$

$$\text{Score (\%)}=\{[\Sigma E(k)/R(k)]/[\Sigma(2/R(k))+\Sigma(1/R(k))]\}\times 100 \quad (4)$$

A score with coating of the lubrication film and a score without coating of the lubrication film were measured, and the ratio between them [(score with coating)/(score without coating)] was determined. The advantageous effects of the present invention were verified by determining whether formability improvement effects by coating of the lubrication film could be further improved, i.e., by determining whether the ratio be 1.0 or more.

Figure 3:
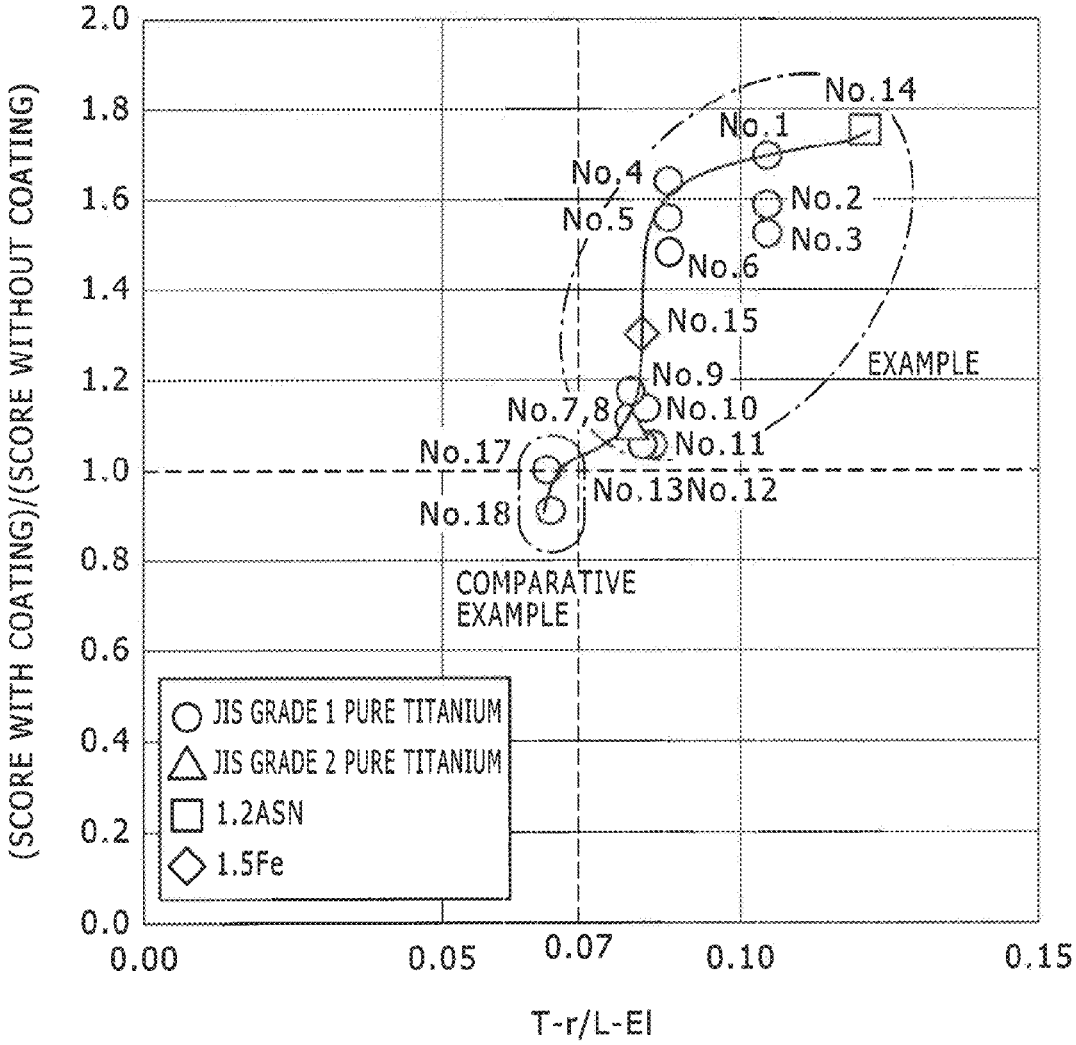
FIG. 3 is a graph illustrating how the ratio [(score with coating)/(score without coating)] varies depending on the ratio [(T-r)/(L-El)].
Figure 4:
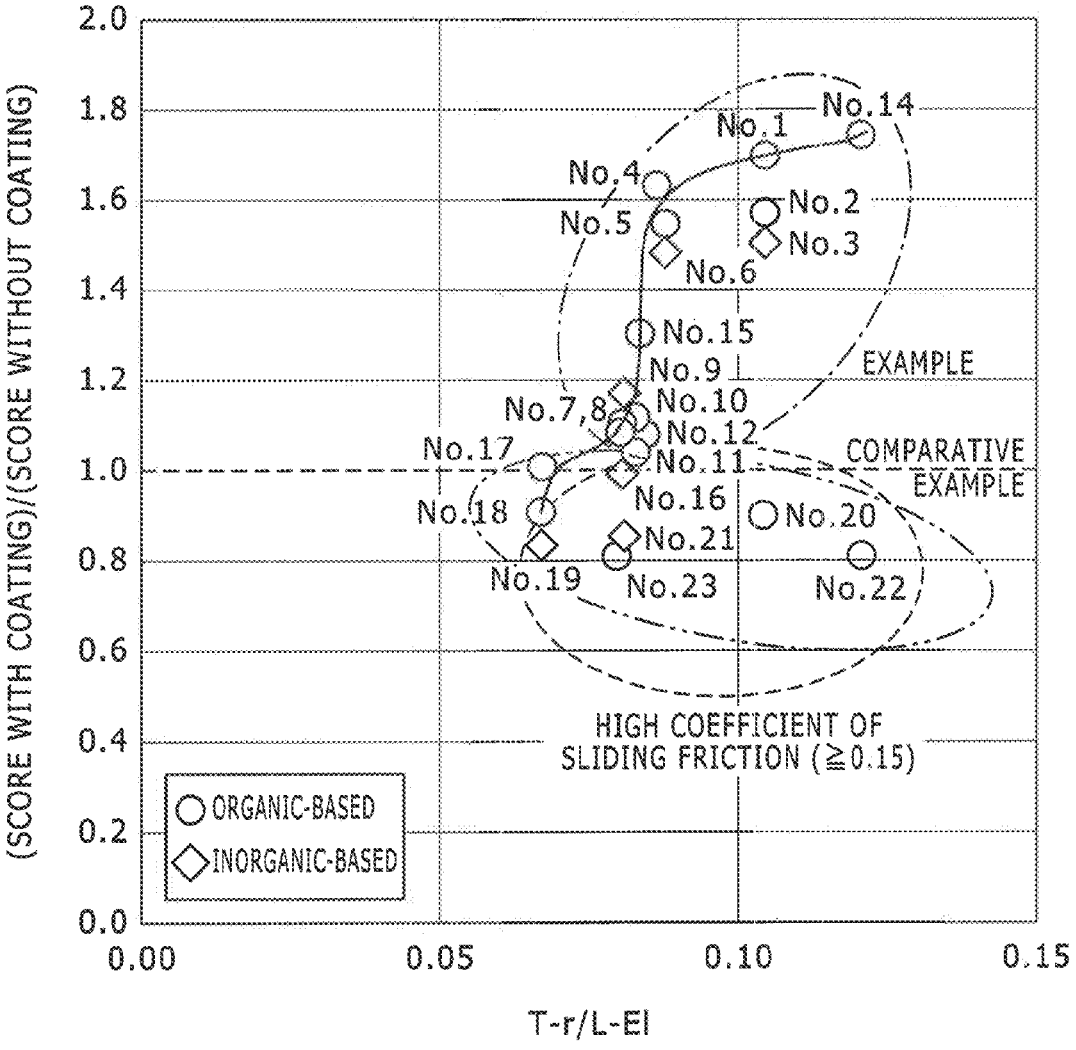
FIG. 4 is a graph illustrating how the ratio [(score with coating)/(score without coating)] varies depending on the ratio [(T-r)/(L-El)] when the lubrication film has a high coefficient of sliding friction (0.15 or more).
Figure 5:
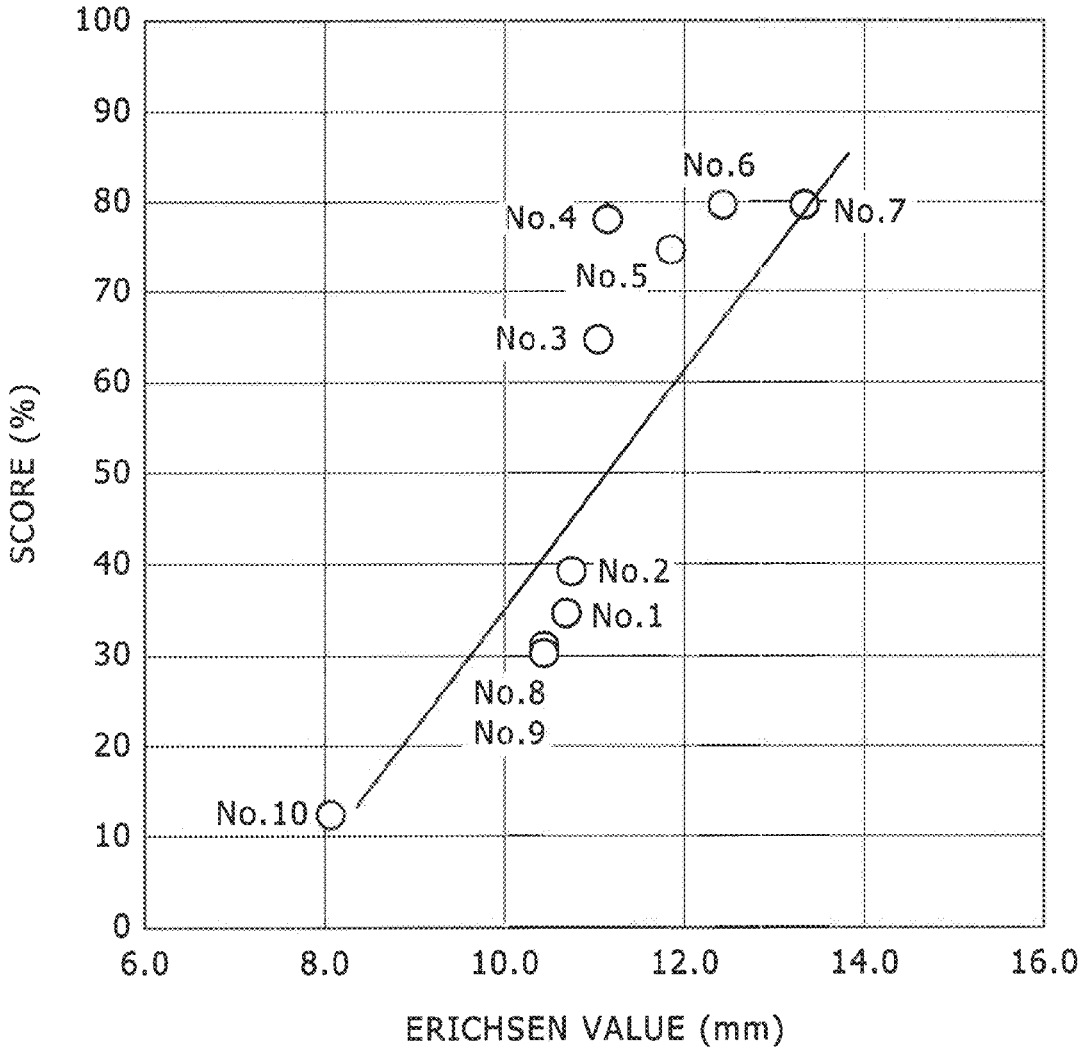
FIG. 5 is a graph illustrating the relationship between the score and the Erichsen value.

The measured data and the tensile properties (L-YS, L-TS, L-El, T-r, and (T-r)/(L-El)) of the titanium plates or titanium alloy plates are all together shown in Table 3 below. These data were analyzed, and FIG. 3 shows how the ratio of the score with coating to the score without coating [(score with coating)/(score without coating)] varies depending on the ratio of L-El to T-r [(T-r)/(L-El)]. Likewise, FIG. 4 shows how the ratio [(score with coating)/(score without coating)] varies depending on the ratio [(T-r)/(L-El)] at high coefficients of sliding friction (0.15 or more); and FIG. 5 shows the relationship between the Erichsen value and the score (score with coating of the lubrication film). In the respective figures, "No." represents the test number.

TABLE 3

| Test number | Titanium type | Tensile properties L-YS (MPa) | L-TS (MPa) | L-EI (%) | T-r | (T-r)/(L-EI) | Erichsen value (mm) | Press formability (score: %) With coating | Without coating | Ratio of score with coating to score without coating |
|---|---|---|---|---|---|---|---|---|---|---|
| 1 | A | 208 | 367 | 34.8 | 3.62 | 0.104 | 10.6 | 57.9 | 34.1 | 1.70 |
| 2 | A | 208 | 367 | 348 | 3.62 | 0.104 | 10.6 | 54.0 | 34.1 | 1.58 |
| 3 | A | 208 | 367 | 34.8 | 3.62 | 0.104 | 10.6 | 51.8 | 34.1 | 1.52 |
| 4 | B | 167 | 328 | 40.6 | 3.55 | 0.087 | 10.7 | 63.7 | 39.0 | 1.63 |
| 5 | B | 167 | 328 | 40.6 | 3.55 | 0.087 | 10.7 | 60.5 | 39.0 | 1.55 |
| 6 | B | 167 | 328 | 40.6 | 3.55 | 0.087 | 10.7 | 57.7 | 39.0 | 1.48 |
| 7 | C | 189 | 307 | 47.4 | 3.82 | 0.081 | 11.0 | 71.8 | 64.8 | 1.11 |
| 8 | C | 189 | 307 | 47.4 | 3.82 | 0.081 | 11.0 | 71.8 | 64.8 | 1.11 |
| 9 | C | 189 | 307 | 47.4 | 3.82 | 0.081 | 11.0 | 76.8 | 64.8 | 1.17 |
| 10 | E | 207 | 312 | 48.2 | 4.01 | 0.083 | 11.8 | 84.8 | 75.2 | 1.13 |
| 11 | F | 209 | 313 | 48.5 | 4.12 | 0.085 | 12.4 | 87.0 | 79.5 | 1.09 |
| 12 | G | 212 | 316 | 48.1 | 4.01 | 0.083 | 13.3 | 84.1 | 80.1 | 1.05 |
| 13 | H | 237 | 394 | 32.8 | 3.07 | 0.081 | 10.4 | 33.9 | 30.8 | 1.10 |
| 14 | I | 311 | 447 | 32.0 | 3.86 | 0.121 | 10.4 | 53.4 | 30.5 | 1.75 |
| 15 | J | 442 | 578 | 23.6 | 1.96 | 0.083 | 8.0 | 15.6 | 12.0 | 1.30 |
| 16 | C | 189 | 307 | 47.4 | 3.82 | 0.081 | 11.0 | 64.2 | 64.8 | 0.99 |
| 17 | D | 183 | 314 | 50.6 | 3.41 | 0.067 | 11.1 | 78.3 | 78.2 | 1.00 |
| 18 | D | 183 | 314 | 50.6 | 3.41 | 0.067 | 11.1 | 70.7 | 78.2 | 0.90 |
| 19 | D | 183 | 314 | 50.6 | 3.41 | 0.067 | 11.1 | 64.4 | 78.2 | 0.82 |
| 20 | A | 208 | 367 | 34.8 | 3.62 | 0.104 | 10.6 | 30.7 | 34.1 | 0.90 |
| 21 | H | 237 | 394 | 32.8 | 3.07 | 0.081 | 10.4 | 26.2 | 30.8 | 0.85 |
| 22 | I | 311 | 447 | 32.0 | 3.86 | 0.121 | 10.4 | 24.4 | 30.5 | 0.80 |
| 23 | J | 442 | 578 | 23.6 | 1.89 | 0.080 | 8.0 | 9.6 | 12.0 | 0.80 |

FIG. 3 demonstrate that the effects of coating of the lubrication film on improvements of formability are effectively exhibited by setting the ratio [(T-r)/(L-El)] to 0.07 or more.

FIG. 4 is a graph illustrating how the ratio [(score with coating)/(score without coating)] varies depending on the ratio [(T-r)/(L-El)] when the lubrication film has a high coefficient of sliding friction (0.15 or more). FIG. 4 demonstrates that the coating of the lubrication film does not so effectively improve press formability unless the lubrication film has a coefficient of sliding friction of less than 0.15.

FIG. 5 demonstrates that the "score" employed in the present invention as an evaluation criterion for press formability has a satisfactory correlation with the Erichsen value; and that the press formability can be precisely evaluated by the score.

The present invention will be illustrated in further detail with reference to several experimental examples below. It should be noted, however, that these examples are never intended to limit the scope of the present invention; and various alternations and modifications without departing from the scope and spirit of the present invention are included within the scope of the present invention. All parts and percentages hereinafter are by mass. Evaluation methods employed in the experimental examples are as follows.

[Evaluation Methods]

(1) Coefficients of Friction

Each surface-treating composition was applied to the metallic plate, dried, and the coefficient of static friction and the coefficient of sliding friction were measured under the following conditions using a surface property tester (TYPE; 14DR) supplied by SHINTO Scientific Co., Ltd. while sliding a stainless steel (SUS) ball with pressurization under a constant load.

Test Load: 500 gf

Sliding Rate: 100 mm/min

Sliding Length: 40 mm

Test Number: n=3

Sliding Jig: SUS ball 10 mm in diameter

Measurement Temperature: room temperature (20° C.)

(2) Press Formability

The press formability was evaluated by the same procedure as the above-mentioned evaluation method for press formability.

(3) Film Removability in Alkali

The film removability of the lubrication film in an alkaline degreasing process was evaluated in the following manner. The mass of coating $V_0$ (g/m$^2$) of the lubrication film deposited on the metallic plate of a specimen was measured, the specimen was soaked in a 20 g/L solution of an alkaline degreaser ("CL-N364S" supplied by Nihon Parkerizing Co., Ltd.) held at 60° C. for 2 minutes, rinsed with water, dried, and the mass of coating $V_1$ (g/m$^2$) of the residual film was measured. The film removal percentage was then determined according to following Expression (5).

[Math. 1]

$$\frac{100 \times (V_0 - V_1)}{V_0} = \text{Film Removal Percentage}(\%) \qquad \text{Expression (5)}$$

The film removability was evaluated according to the following criteria. A sample having a film removal percentage of 100% was evaluated as having excellent film removability (◎); a sample having a film removal percentage of 95% or more and less than 100% was evaluated as having good film removability (○); a sample having a film removal percentage of 90% or more and less than 95% was evaluated as having average film removability (Δ); and a sample having a film removal percentage of less than 90% was evaluated as having poor film removability (X).

The mass of coating ($g/m^2$) of the film was determined by measuring the amount of silicon element in the film using an X-ray fluorescence spectrometer ("MIF-2100" supplied by Shimadzu Corporation) and converting the silicon amount into the mass of coating according to following Expression (6):

[Math. 2]

$$\frac{Si \times 60 \times 100}{28 \times C \times 1000} = \text{Mass of coating } (g/m^2) \qquad \text{Expression (6)}$$

In Expression (6), "Si" represents the content ($mg/m^2$) of silicon element in the film; "C" represents the content of $SiO_2$ in the surface-treating composition; "28" is the atomic weight of silicon (Si); and "60" is the molecular weight of $SiO_2$.

Preparation Example 1

Water (400 parts) was placed in a four-necked flask equipped with a stirrer, a thermometer, a reflux condenser, and dropping funnels, followed by heating to 80° C. while performing nitrogen purge. An initiator aqueous solution was prepared by dissolving 0.4 part of ammonium persulfate in 200 parts of water. Independently, a pre-emulsion was prepared by mixing and emulsifying 60 parts of methacrylic acid as an unsaturated carboxylic acid, 77.4 parts of n-butyl methacrylate and 65.6 parts of 2-ethylhexyl acrylate both as unsaturated carboxylic acid esters, 200 parts of water, and 15 parts of a reactive surfactant "LATEMUL (registered trademark) S-180" (supplied by Kao Corporation). The initiator aqueous solution and the pre-emulsion were placed in different dropping funnels and added dropwise to the water simultaneously over 1 hour. After the completion of dropwise addition, the mixture was aged at 80° C. for 1 hour, cooled to 40° C., filtrated through a 150-mesh wire gauge, and thereby yielded a copolymer emulsion No. 1.

Preparation Example 2

A copolymer emulsion No. 2 was prepared by the procedure of Preparation Example 1, except for using, as the unsaturated carboxylic acid ester, 140 parts of ethyl acrylate alone.

Preparation Example 3

A copolymer emulsion No. 3 was prepared by the procedure of Preparation Example 2, except for using methacrylic acid in an amount of 40 parts and ethyl acrylate in an amount of 150 parts.

Preparation Example 4

A copolymer emulsion No. 4 was prepared by the procedure of Preparation Example 2, except for using methacrylic acid in an amount of 80 parts and ethyl acrylate in an amount of 130 parts.

Preparation Example 5

A copolymer emulsion No. 5 was prepared by the procedure of Preparation Example 4, except for using methacrylic acid in an amount of 90 parts.

Preparation Example 6

A copolymer emulsion No. 6 was prepared by the procedure of Preparation Example 3, except for using methacrylic acid in an amount of 30 parts.

Preparation Example 7

A copolymer emulsion No. 7 was prepared by performing emulsion polymerization by the procedure of Preparation Example 2, aging the reaction mixture at 80° C. for 1 hour, gradually adding dropwise about 10 parts of a 50% aqueous solution of triethylamine until the pH be 6, further continuously aging for 30 minutes, and thereafter performing cooling and filtration by the procedure of Preparation Example 1.

Preparation Example 8

A copolymer emulsion No. 8 was prepared by the procedure of Preparation Example 2, except for using methacrylic acid in an amount of 180 parts and ethyl acrylate in an amount of 20 parts.

The compositions and properties of the respective copolymers are summarized in Table 4.

TABLE 4

| | Copolymer composition (%) | | | | | |
|---|---|---|---|---|---|---|
| Preparation Example Number | Methacrylic acid | n-Butyl methacrylate | 2-Ethylhexyl acrylate | Ethyl acrylate | Acid value (mgKOH/g) | pH |
| 1 | 29.6 | 38.1 | 32.3 | — | 200 | 3.0 |
| 2 | 30.0 | — | — | 70.0 | 200 | 2.5 |
| 3 | 21.1 | — | — | 78.9 | 155 | 3.7 |
| 4 | 38.1 | — | — | 61.9 | 260 | 3.2 |
| 5 | 40.9 | — | — | 59.1 | 270 | 3.0 |
| 6 | 16.7 | — | — | 83.3 | 100 | 3.9 |
| 7 | 30.0 | — | — | 70.0 | 200 | 6.3 |
| 8 | 90.0 | — | — | 10.0 | 360 | 1.4 |

Experimental Example 1

Surface-treating compositions Nos. 1 to 8 were prepared by using each of the copolymer emulsions Nos. 1 to 8 prepared in Preparation Examples 1 to 8, a colloidal silica having a particle size of 40 to 50 nm ("SNOWTEX (registered trademark) OL"; supplied by Nissan Chemical Industries, Ltd.), a spherical polyethylene wax having an average particle size of 1 μm ("CHEMIPEARL (registered trademark) W-700"; having a softening point of 132° C.; supplied by Mitsui Chemicals Inc.), and a spherical polyethylene wax having an average particle size of 0.6 μm ("CHEMIPEARL (registered trademark) W-900"; having a softening point of 132° C.; supplied by Mitsui Chemicals Inc.). The compounding ratio was such that each composition contained, in terms of solids content, 85% of the copolymer, 10% of the silica, and 5% of the wax mixture. The wax mixture contained the wax having an average particle size of 1 μm and the wax having an average particle size of 0.6 μm in equal proportions (each 50%).

Base plates used were a JIS Grade 1 pure titanium plate, a JIS Grade 2 pure titanium plate, an electrogalvanized steel sheet (mass of coating: 20 g/m$^2$ on each side; EG), and a hot-dip galvanized steel sheet (mass of coating: 60 g/m$^2$ on each side; GI) each having a thickness of 0.5 mm. The titanium plate used herein was composed of type H titanium described in Tables 1 to 3. Each of the surface-treating compositions Nos. 1 to 8 was applied to both sides of the base plate, dried in an air forced oven at an exit-side plate temperature of 120° C., and thereby yielded a series of metallic plates each coated with an alkali-soluble lubrication film in a mass of coating of 1.0 g/m$^2$.

The data relating to the titanium plates are shown in Table 5. Testing No. 1 is a sample in which the JIS Grade 1 pure titanium plate was coated with a press oil alone; and Testing No. 2 is a sample in which the JIS Grade 2 pure titanium plate was coated with a press oil alone. Testing Nos. 3 to 10 are samples in which the JIS Grade 2 pure titanium plate used as the base plate was coated with a surface-treating composition; of which Testing Nos. 3 to No. 6 are examples according to the present invention, and Testing Nos. 7 to 10 are comparative examples.

Experimental Example 2

A series of metallic plates each coated with an alkali-soluble lubrication film was prepared by applying a surface-treating compositions to a JIS Grade 2 pure titanium plate having a thickness of 0.5 mm and drying the coated film by the procedure of Experimental Example 1, except for using the wax having an average particle size of 1 μm and the wax having an average particle size of 0.6 μm in the proportions given in Table 7 and using the copolymer emulsion No. 1 alone as the copolymer emulsion, while the proportions of components in the composition, i.e., 85% of the copolymer, 10% of the silica, and 5% of the wax mixture were not changed. The evaluation results of the coated metallic plates are shown in Table 7.

TABLE 5

| Testing No. | Base plate | Surface-treating composition No. | Coefficient of friction: Coefficient of static friction (μS) | Coefficient of friction: Coefficient of sliding friction (μK) | Coefficient of friction: μS − μK | Press formability (score) | Film removability in alkali |
|---|---|---|---|---|---|---|---|
| 1 | JIS Grade 1 pure titanium plate | — | 0.594 | 0.708 | −0.114 | 46 | unmeasured |
| 2 | JIS Grade 2 pure titanium plate | — | 0.204 | 0.683 | −0.479 | 28 | unmeasured |
| 3 | JIS Grade 2 pure titanium plate | No. 1 | 0.104 | 0.096 | 0.008 | 71 | ◎ |
| 4 | JIS Grade 2 pure titanium plate | No. 2 | 0.107 | 0.098 | 0.009 | 70 | ◎ |
| 5 | JIS Grade 2 pure titanium plate | No. 3 | 0.108 | 0.099 | 0.009 | 70 | ○ |
| 6 | JIS Grade 2 pure titanium plate | No. 4 | 0.112 | 0.103 | 0.009 | 71 | ◎ |
| 7 | JIS Grade 2 pure titanium plate | No. 5 | 0.169 | 0.121 | 0.048 | 50 | ◎ |
| 8 | JIS Grade 2 pure titanium plate | No. 6 | 0.078 | 0.064 | 0.014 | 71 | X |
| 9[1)] | JIS Grade 2 pure titanium plate | No. 7 | 0.148 | 0.127 | 0.021 | 64 | X |
| 10[2)] | JIS Grade 2 pure titanium plate | No. 8 | 0.240 | 0.289 | −0.049 | 57 | ◎ |

[1)]A uniform film was not formed because of dot-like crawling occurred upon the application of the surface-treating composition.

[2)]The surface-treating composition was separated into two layers after its preparation, because the wax particles rose to the surface. The composition was applied immediately after stirring to give the specimen.

The data relating to EG and GI are shown in Table 6. Testing Nos. 11 and 15 were samples in which the base plate was coated with a press oil; and Testing Nos. 12 and 16 are samples in which press forming was performed after a polyethylene sheet (thickness 20 μm; a plastic bag supplied by SANIPAK COMPANY OF JAPAN, LTD.)) was placed on the metallic plate. Testing Nos. 13, 14, 17, and 18 are examples according to the present invention, and the other samples are comparative examples.

TABLE 6

| Testing No. | Base plate | Surface-treating composition No. | Coefficient of friction: Coefficient of static friction (μS) | Coefficient of friction: Coefficient of sliding friction (μK) | Coefficient of friction: μS − μK | Press formability (score) | Film removability in alkali |
|---|---|---|---|---|---|---|---|
| 11 | EG | — | 0.467 | 0.478 | −0.011 | 61 | unmeasured |
| 12 | EG | polyethylene sheet | unmeasured | unmeasured | — | 96 | unmeasured |
| 13 | EG | No. 1 | 0.114 | 0.098 | 0.016 | 98 | ◎ |
| 14 | EG | No. 2 | 0.110 | 0.092 | 0.018 | 97 | ◎ |
| 15 | GI | — | 0.368 | 0.566 | −0.198 | 42 | unmeasured |
| 16 | GI | polyethylene sheet | unmeasured | unmeasured | — | 78 | unmeasured |
| 17 | GI | No. 1 | 0.122 | 0.118 | 0.004 | 74 | ◎ |
| 18 | GI | No. 2 | 0.119 | 0.102 | 0.017 | 75 | ◎ |

TABLE 7

| Testing No. | Compounding ratio of waxes 1.0 μm (%) | Compounding ratio of waxes 0.6 μm (%) | Coefficient of friction: Coefficient of static friction (μS) | Coefficient of friction: Coefficient of sliding friction (μK) | μS − μK | Press formability (score) | Film removability in alkali |
|---|---|---|---|---|---|---|---|
| 3 | 50 | 50 | 0.104 | 0.096 | 0.008 | 71 | ◎ |
| 19 | 60 | 40 | 0.102 | 0.100 | 0.002 | 68 | ◎ |
| 20 | 70 | 30 | 0.100 | 0.117 | −0.017 | 64 | ◎ |
| 21 | 85 | 15 | 0.118 | 0.121 | −0.003 | 52 | ◎ |
| 22 | 100 | 0 | 0.109 | 0.138 | −0.029 | 42 | ◎ |
| 23 | 0 | 100 | 0.166 | 0.133 | 0.033 | 38 | ◎ |

Experimental Example 3

A series of metallic plates each coated with an alkali-soluble lubrication film was prepared by applying a surface-treating compositions to a JIS Grade 2 pure titanium plate having a thickness of 0.5 mm and drying the coated film by the procedure of Experimental Example 1, except for using the wax mixture in the amount given in Table 8, using the copolymer in the amount given in Table 8 so as to allow the total amount of the copolymer, the silica, and the wax mixture to be 100%, and using the copolymer emulsion No. 1 alone as the copolymer emulsion. In this process, the silica was used in the same amount as in Experimental Example 1 (10%). The wax mixture herein was a 50:50 mixture of the wax having an average particle size of 1 μm and the wax having an average particle size of 0.6 μm. The evaluation results of the prepared coated metallic plates are shown in Table 8.

b: "CHEMIPEARL (registered trademark) W-900" (having an average diameter of 0.6 μm and a softening point of 132° C.; supplied by Mitsui Chemicals Inc.)

c: "CHEMIPEARL (registered trademark) W-300" (having an average diameter of 3 μm and a softening point of 132° C.; supplied by Mitsui Chemicals Inc.)

d: "CHEMIPEARL (registered trademark) W-500" (having an average diameter of 2.5 μm and a softening point of 113° C.; supplied by Mitsui Chemicals Inc.)

e: "CHEMIPEARL (registered trademark) WF-640" (having an average diameter of 1.0 μm and a softening point of 113° C.; supplied by Mitsui Chemicals Inc.)

f: "CHEMIPEARL (registered trademark) W-950" (having an average diameter of 0.6 μm and a softening point of 113° C.; supplied by Mitsui Chemicals Inc.)

g: Fluorine lubricant "KTL 500F" (having an average diameter of 0.49 μm (actual value) and a melting point of 310° C.; supplied by Kitamura Ltd.)

TABLE 8

| Testing No. | Copolymer (%) | Wax mixture (%) | Coefficient of friction: Coefficient of static friction (μS) | Coefficient of friction: Coefficient of sliding friction (μK) | μS − μK | Press formability (score) | Film removability in alkali |
|---|---|---|---|---|---|---|---|
| 3 | 85 | 5 | 0.104 | 0.096 | 0.008 | 71 | ◎ |
| 24 | 86.5 | 3.5 | 0.116 | 0.103 | 0.013 | 68 | ◎ |
| 25 | 83 | 7 | 0.074 | 0.061 | 0.013 | 78 | ◎ |
| 26 | 82 | 8 | 0.076 | 0.062 | 0.014 | 74 | ◎ |
| 27 | 80 | 10 | 0.078 | 0.060 | 0.018 | 69 | ◎ |
| 28 | 78 | 12 | 0.108 | 0.066 | 0.042 | 61 | ◎ |
| 29 | 88 | 2 | 0.152 | 0.095 | 0.057 | 50 | ◎ |
| 30 | 90 | 0 | 0.204 | 0.289 | −0.085 | 43.6 | ◎ |

Experimental Example 4

A series of surface-treating compositions was prepared by the procedure as above, except for using the copolymer emulsion No. 1 alone as the copolymer emulsion but not changing the proportions of components of the composition, i.e., 85% of the copolymer, 10% of the silica, and 5% of the wax mixture (or a mixture of a wax and a fluorine lubricant). The mixtures of waxes or of a wax and a fluorine lubricant used herein were each a 50:50(%) mixture of one having a larger average particle size and one having a smaller average particle size. The types of the waxes and fluorine lubricants are shown below. The waxes under the trade names of CHEMIPEARL are all spherical polyethylene waxes.

a: "CHEMIPEARL (registered trademark) W-700" (having an average diameter of 1 μm and a softening point of 132° C.; supplied by Mitsui Chemicals Inc.)

h: Fluorine lubricant "PTFE 31-JR" (having an average diameter of 0.2 to 0.25 μm and a melting point of 327° C.; supplied by Du Pont-Mitsui Fluorochemicals Co., Ltd.)

In addition, the mass of coating of the film was modified in the range of 0.5 to 2.0 g/m$^2$ as given in Table 9. A series of metallic plates each coated with an alkali-soluble lubrication film was prepared by applying each surface-treating composition to a JIS Grade 2 pure titanium plate having a thickness of 0.5 mm and drying the coated film by the procedure of Experimental Example 1, except for changes in the above-mentioned conditions. The evaluation results of these are shown in Table 9.

The film thickness in Table 9 is an approximate value obtained by converting the mass of coating (g/m$^2$) of the film according to the following expression. The following expression was employed, because the film contained the colloidal silica having a specific gravity of 2.2 in a content of 10%, and the resin and waxes each having a specific gravity of 1.0 in a total content of 90%.

[Math. 3]

$$\frac{\text{Mass of coating (g/m}^2)\times 0.1}{2.2} + \frac{\text{Mass of coating (g/m}^2)\times 0.9}{1.0} = \text{Film thickness}(\mu\text{m}) \quad \text{Expression (7)}$$

10, and using the copolymer in an amount so as to allow the total amount of the copolymer, silica, and wax mixture to be 100%. The evaluation results of the prepared coated metallic plates are shown in Table 10.

The colloidal silica used herein is as follows:

I: "SNOWTEX (registered trademark) OL" (having a pH of 2 to 4 and a particle size of 40 to 50 nm; supplied by Nissan Chemical Industries, Ltd.)

II: "SNOWTEX (registered trademark) 0" (having a pH of 2 to 4 and a particle size of 10 to 20 nm; supplied by Nissan Chemical Industries, Ltd.)

TABLE 9

| | Wax type | | | | Coefficient of friction | | | | |
|---|---|---|---|---|---|---|---|---|---|
| Testing No. | Wax having larger particle size | Wax having smaller particle size | Mass of coating (g/m$^2$) | Film thickness (μm) | Coefficient of static friction (μS) | Coefficient of sliding friction (μK) | μS − μK | Press formability (score) | Film removability in alkali |
| 3 | a | b | 1.0 | 0.95 | 0.104 | 0.096 | 0.008 | 71 | ◎ |
| 31 | a | b | 0.6 | 0.57 | 0.114 | 0.123 | −0.009 | 66 | ◎ |
| 32 | a | b | 1.5 | 1.42 | 0.119 | 0.102 | 0.017 | 70 | ○ |
| 33 | a | f | 1.0 | 0.95 | 0.103 | 0.102 | 0.001 | 69 | ◎ |
| 34 | e | f | 1.0 | 0.95 | 0.109 | 0.109 | 0.000 | 68 | ◎ |
| 35 | e | b | 1.0 | 0.95 | 0.120 | 0.108 | 0.012 | 68 | ◎ |
| 36 | a | b | 0.5 | 0.47 | 0.148 | 0.127 | 0.021 | 49 | ◎ |
| 37 | a | b | 1.6 | 1.51 | 0.150 | 0.106 | 0.044 | 60 | Δ |
| 38 | a | b | 2.0 | 1.89 | 0.164 | 0.108 | 0.056 | 53 | X |
| 39 | c | b | 1.5 | 1.42 | 0.186 | 0.123 | 0.063 | 52 | Δ |
| 40 | d | b | 1.5 | 1.42 | 0.192 | 0.142 | 0.050 | 49 | Δ |
| 41 | c | a | 1.5 | 1.42 | 0.188 | 0.136 | 0.052 | 51 | Δ |
| 42 | d | a | 1.5 | 1.42 | 0.197 | 0.144 | 0.053 | 48 | Δ |
| 43 | a | g | 1.0 | 0.95 | 0.148 | 0.102 | 0.046 | 50 | ◎ |
| 44 | a | h | 1.0 | 0.95 | 0.139 | 0.114 | 0.025 | 50 | ◎ |

Experimental Example 5

A series of metallic plates each coated with an alkali-soluble lubrication film was prepared by applying a surface-treating compositions to a JIS Grade 2 pure titanium plate having a thickness of 0.5 mm and drying the coated film by the procedure of Experimental Example 1, except for using the copolymer emulsion No. 1 as the copolymer emulsion, using the wax mixture (a 50:50 mixture of a wax having an average particle size of 1 μm and a wax having an average particle size of 0.6 μm) in an amount of 5%, using a silica of the type given in Table 10 in the amount given in Table III: "SNOWTEX (registered trademark) OUP" (having a pH of 2 to 4 and a particle size of 40 to 100 nm; supplied by Nissan Chemical Industries, Ltd.)

IV: "SNOWTEX (registered trademark) AK" (having a pH of 4 to 6 and a particle size of 10 to 20 nm; supplied by Nissan Chemical Industries, Ltd.)

V: "SNOWTEX (registered trademark) 20L" (having a pH of 9.5 to 11.0 and a particle size of 40 to 50 nm; supplied by Nissan Chemical Industries, Ltd.)

TABLE 10

| | | | | Coefficient of friction | | | | | |
|---|---|---|---|---|---|---|---|---|---|
| Testing No. | Copolymer (%) | Colloidal silica Type | Colloidal silica Amount (%) | Coefficient of static friction (μS) | Coefficient of sliding friction (μK) | μS − μK | Press formability (score) | Film removability in alkali | State of surface-treating composition |
| 3 | 85 | I | 10 | 0.104 | 0.096 | 0.008 | 71 | ◎ | good |
| 45 | 90 | I | 5 | 0.104 | 0.099 | 0.005 | 70 | ○ | good |
| 46 | 80 | I | 15 | 0.106 | 0.098 | 0.008 | 71 | ◎ | good |
| 47 | 75 | I | 20 | 0.104 | 0.102 | 0.002 | 67 | ◎ | good |
| 48 | 95 | — | 0 | 0.105 | 0.119 | −0.014 | 64 | X | good |
| 49 | 70 | I | 25 | 0.124 | 0.146 | −0.022 | 57 | X | precipitated |
| 50 | 85 | II | 10 | 0.104 | 0.109 | −0.005 | 66 | Δ | gelled |
| 51 | 85 | III | 10 | 0.224 | 0.193 | 0.031 | 44 | ○ | precipitated |
| 52 | 85 | IV | 10 | — | — | — | — | — | uncoatable |
| 53 | 85 | V | 10 | — | — | — | — | — | uncoatable |

INDUSTRIAL APPLICABILITY

The metallic plates each coated with an alkali-soluble lubrication film according to the present invention include the lubrication film excellent in press formability and film removability in alkali and may exhibit excellent press formability even when the base plate is a titanium plate which is considered to have poor workability according to conventional techniques. The lubrication film for use in the present invention excels in film removability in alkali, may thereby be easily removed by an alkaline degreasing treatment after press forming, and does not adversely affect coating in a subsequent electrophoretic coating process. For these reasons, the metallic plates coated with the alkali-soluble lubrication film according to the present invention are suitably adopted to applications where severe forming is applied. Among such applications, the metallic plates are optimal for heat-exchange units of plate-type heat exchangers. The metallic plates are also adoptable to other applications such as household electrical appliances, building materials, and materials for transportation vehicles, such as parts for ships and automobiles.

The invention claimed is:

1. A titanium or titanium alloy plate, comprising a titanium or titanium alloy base plate having been rolled in one direction and a lubrication film applied on a surface of the titanium or titanium alloy base plate, wherein the surface of the lubrication film has a coefficient of sliding friction less than 0.15, and wherein the titanium or titanium alloy base plate has an elongation in the rolling direction (L-El) and a r value in a direction perpendicular to the rolling direction (T-r) as determined by the ASTM E8 protocol, and wherein:

$$(T\text{-}r)/(L\text{-}El) \geq 0.07.$$

2. The titanium or titanium alloy plate according to claim 1, wherein the titanium or titanium alloy base plate has a thickness of from 0.3 to 1.0 mm.

3. The titanium or titanium alloy plate according to claim 1, wherein $$0.2 \geq (T\text{-}r)/(L\text{-}El) \geq 0.07.$$

4. The titanium or titanium alloy plate according to claim 1, wherein said plate is a titanium alloy plate.

5. The titanium or titanium alloy plate according to claim 1, wherein said plate is a titanium plate.

6. The titanium or titanium alloy plate according to claim 1, wherein the lubrication film is an alkali-soluble lubrication film comprising a surface-treating composition, and wherein the surface-treating composition comprises a copolymer (A), a colloidal silica (B), and a wax mixture (C), wherein the copolymer (A) is synthesized from monomer components comprising a constitutional unit (A-1) derived from an α,β-ethylenically unsaturated carboxylic acid and a constitutional unit (A-2) derived from an α,β-ethylenically unsaturated carboxylic acid ester.

7. The titanium or titanium alloy plate according to claim 1, wherein the lubrication film is an alkali-soluble lubrication film comprising a surface-treating composition, and wherein the surface-treating composition comprises a copolymer (A), a colloidal silica (B), and a wax mixture (C), wherein the copolymer (A) is synthesized from monomer components comprising a constitutional unit (A-1) derived from an α,β-ethylenically unsaturated carboxylic acid and a constitutional unit (A-2) derived from an α,β-ethylenically unsaturated carboxylic acid ester, the colloidal silica (B) has a particle size of from 40 to 50 nm, and the wax mixture (C) comprises a spherical polyethylene wax with an average particle size of 1 μm (C-1) and a spherical polyethylene wax with an average particle size of 0.6 μm (C-2).

8. The titanium or titanium alloy plate according to claim 7, wherein the C-2 in wax mixture (C) comprises 30 to 50 percent by mass of wax mixture C.

9. The titanium or titanium alloy plate according to claim 7, wherein the wax C-1 has a softening point of from 113° C. to 132° C. and the wax C-2 has a softening point of from 113° C. to 132° C.

10. The titanium or titanium alloy plate according to claim 7, wherein the surface of the alkali-soluble lubrication film has a coefficient of static friction of 0.15 or less and a coefficient of sliding friction of 0.15 or less, and wherein a value obtained by subtracting the coefficient of sliding friction from the coefficient of static friction is from −0.02 to +0.02.

11. The titanium or titanium alloy plate according to claim 7, wherein the surface-treating composition comprises the copolymer (A) from 70 to 90 percent by mass, the colloidal silica (B) from 5 to 20 percent by mass, and the wax mixture (C) from 3.5 to 10 percent by mass, based on the total mass (100 percent by mass) of the copolymer (A), the colloidal silica (B), and the wax mixture (C).

12. The titanium or titanium alloy plate according to claim 7, wherein A-1 is derived from methacrylic acid, and comprises from 20 to 40 percent by mass of copolymer (A).

13. The titanium or titanium alloy plate according to claim 7, wherein the copolymer (A) has an acid value of 150 mgKOH/g or more.

14. The titanium or titanium alloy plate according to claim 7, wherein the alkali-soluble lubrication film has a mass of coating of from 0.6 to 1.5 g/m$^2$.

* * * * *